US009425493B2

(12) United States Patent
Lin et al.

(10) Patent No.: US 9,425,493 B2
(45) Date of Patent: Aug. 23, 2016

(54) CAVITY RESONATOR FILTERS WITH PEDESTAL-BASED DIELECTRIC RESONATORS

(71) Applicant: Alcatel-Lucent USA Inc., Murray Hill, NJ (US)

(72) Inventors: Tsu-Wei Lin, Taichung (TW); Noriaki Kaneda, Westfield, NJ (US)

(73) Assignee: Alcatel Lucent, Boulogne-Billancourt (FR)

( * ) Notice: Subject to any disclaimer, the term of this patent is extended or adjusted under 35 U.S.C. 154(b) by 0 days.

(21) Appl. No.: 14/480,976

(22) Filed: Sep. 9, 2014

(65) Prior Publication Data

US 2016/0072169 A1 Mar. 10, 2016

(51) Int. Cl.

| | |
|---|---|
| ***H01P 1/20*** | (2006.01) |
| ***H01P 1/208*** | (2006.01) |
| ***H01P 7/10*** | (2006.01) |

(52) U.S. Cl.

CPC ..... *H01P 1/2084* (2013.01); *H01P 7/10* (2013.01)

(58) Field of Classification Search

CPC ..... H01P 1/2084; H01P 1/2086; H01P 7/10; H01P 7/105

USPC ..... 333/202

See application file for complete search history.

(56) References Cited

U.S. PATENT DOCUMENTS 4,241,322 A * 12/1980 Johnson ..... H01P 7/10 333/202
6,002,311 A * 12/1999 Wey ..... H01P 7/10 333/202
8,031,036 B2 * 10/2011 Panariello ..... H01P 7/10 333/202
2002/0041221 A1 * 4/2002 Abdulnour ..... H01P 7/10 333/202
2004/0051603 A1 * 3/2004 Pance ..... H01P 1/162 333/202
2006/0197631 A1 * 9/2006 Pance ..... H01P 1/2084 333/202
2012/0169435 A1 7/2012 Kaneda et al.

OTHER PUBLICATIONS

Rhea, Randall W., "Transmission Zeros in Filter Design," Agilent EEsof EDA, Agilent Technologies, Jan. 1, 2001, [Retrieved from] <http://literature.agilent.com/litweb/pdf/5989-9290EN.pdf> on Aug. 4, 2014, 5 pages.

Höft et al., "Compact Base-Station Filters Using TM-Mode Dielectric Resonators," [Retrieved from] <http://duepublico.uni-duisburg-essen.de/servlets/DerivateServlet/Derivate-14694/Final_Papers/GM0013-F.pdf> on Aug. 18, 2014, 4 pages.

(Continued)

*Primary Examiner* — Benny Lee

(74) *Attorney, Agent, or Firm* — Mendelsohn Dunleavy, P.C.; Edward Meisarosh; Steve Mendelsohn

(57) ABSTRACT

In one embodiment, a filter includes two sets of dielectric resonators mounted in corresponding sets of metallic resonant cavities. Adjoining resonant cavities are separated by a wall that have an opening. Each dielectric resonator of the first and second sets has a post and a single connected pedestal and is mounted within its corresponding cavity so that the post contacts a first cavity wall and the pedestal is separated from the opposing wall by an air gap. Each dielectric resonator of the first set is oriented in a first direction, with its pedestal on the bottom. Each dielectric resonator of the second set is oriented in a second direction, opposite to the first, with its pedestal on the top. The filter's (i) source port couples with a resonator of the first set and (ii) load port couples with a resonator of the second set.

20 Claims, 5 Drawing Sheets

(56) References Cited

OTHER PUBLICATIONS

Höft, Michael, "Bandpass Filter using TM-Mode Dielectric Rod Resonators with Novel Input Coupling," Microwave Symposium Digest, 2009, MTT '09, IEEE MTT-S International, Jun. 7-12, 2009, pp. 1601-1604.

Bastioli et al., "In-Line Eighth-Order Pseudoelliptic Filter using Dielectric Resonator Quadruplets Implemented using bypassing Evanescent Modes," Wireless Symposium (IWS), 2013 IEEE International, Apr. 14-18, 2013, pp. 1-4.

Wang et al., "True Inline Cross-Coupled Coaxial Cavity Filters," IEEE Transactions on Microwave Theory and Techniques, vol. 57, Issue 12, Dec. 2009, pp. 2958-2965.

U.S. Appl. No. 14/060,946, filed Oct. 23, 2013.

* cited by examiner

100

300

301

200

201

400

500

600

600

CAVITY RESONATOR FILTERS WITH PEDESTAL-BASED DIELECTRIC RESONATORS

BACKGROUND

1. Field

The current disclosure relates to cavity-resonator filters, and more specifically, but not exclusively, to cavity-resonator filters with pedestal-based dielectric resonators.

2. Description of the Related Art

Conventional dielectric-loaded cavity resonators are devices that include one dielectric posts inside one metallic chamber, while conventional dielectric-loaded cavity filters are devices that include one or more dielectric-loaded resonators interconnected in metallic chambers. Dielectric-loaded cavity resonators are used as radio-frequency (RF) filters thanks to their high Q factors. The Q, or quality, factor is a parameter that indicates a resonator's level of under-damping, where a higher Q factor indicates that resonant oscillations in the resonator die out more slowly.

Conventional dielectric-loaded cavity resonators use cylindrical dielectric posts. Individual dielectric-loaded resonators may couple to other dielectric-loaded resonators by capacitive coupling or inductive coupling. Couplings between resonators of a filter correspond to zeros and poles in the frequency-response characteristics of the filter. The numbers of poles in the frequency-response characteristics of a resonant filter may be increased by increasing the number of resonators. The number of zeros in the frequency-response characteristics of a resonant filter may be increased by increasing the number of cross coupled dielectric-loaded resonators as opposed to serial coupled resonators. Generally, the greater the number of zeros and poles in the frequency-response characteristics, the more flexibly the frequency-response curve can be shaped. More zeros can help define a sharper drop-off from the pass-band and, consequently, provide a higher Q factor.

Capacitive coupling between dielectric-loaded resonators is conventionally accomplished using a conductor between the coupled posts. Inductive coupling is conventionally accomplished using openings between the chambers of the coupled resonators. These openings are sometimes referred to as irises.

FIG. 1 shows a perspective view of an uncovered conventional resonator filter 100. The top side (not shown) of the filter 100 is a rectangular metal plate that covers the shown uncovered portion. Filter 100 comprises metal housing 101, which houses four dielectric resonator posts 102(1), 102(2), 102(3), and 102(4) arranged within a 2×2 array of corresponding resonant cavities 103(1), 103(2), 103(3), and 103(4). Filter 100 includes source port 105(1) and load port 105(2), which connect to input and output, respectively, of filter 100. Ports 105 are in the form of apertures in conductive micro-strips.

Some of the walls separating adjoining resonant cavities have openings between them, such as opening 104(1) between cavities 103(1) and 103(2). As noted above, opening 104(1) between cavities 103(1) and 103(2) allows for inductive coupling between the corresponding dielectric resonators 102(1) and 102(2).

Capacitive coupling between pairs of dielectric resonators may be accomplished using coupling conductive wires, such as conductor 106 between dielectric resonators 102(1) and 102(4). Note that coupling conductor 106 comes close to, but does not contact, dielectric resonators 102(1) and 102(4). The incorporation of conductor 106 into filter 100 increases the costs of production for filter 100 and restricts the filter topology such that length of 106 is short.

SUMMARY

One embodiment of the disclosure can be a cavity-resonator filter comprising (1) a first set of one or more pedestal-based dielectric resonators, each mounted in a corresponding resonant cavity and oriented in a first direction and (2) a second set of one or more pedestal-based dielectric resonators, each mounted in corresponding resonant cavity and oriented in a second direction opposite to the first direction. Each dielectric resonator of the first and second sets comprises only one post connected to only one pedestal.

Another embodiment of the disclosure can be a method for filtering a signal to generate a filtered signal, the method comprising applying the signal to a filter comprising (1) a first set of one or more pedestal-based dielectric resonators mounted in corresponding resonant cavities and oriented in a first direction and (2) a second set of one or more pedestal-based dielectric resonators mounted in corresponding resonant cavities and oriented in a second direction opposite to the first direction. Each dielectric resonator of the first and second sets comprises only one post connected to only one pedestal. The method further comprises receiving the filtered signal from the filter.

BRIEF DESCRIPTION OF THE DRAWINGS

Other embodiments of the invention will become apparent. In the accompanying drawings, like reference numerals identify similar or identical elements.

DETAILED DESCRIPTION

Figure 2A:
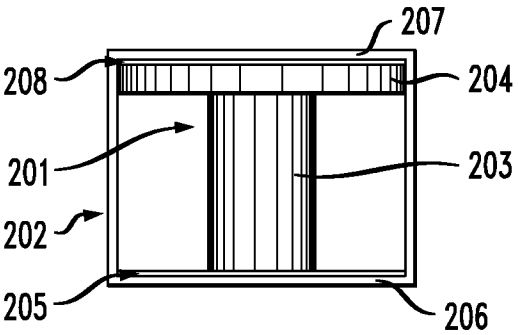
FIG. 2A shows a side cross-section view of a dielectric-loaded cavity resonator in accordance with one embodiment of the present disclosure.

FIG. 2A shows a side cross-section view of dielectric-loaded cavity resonator 200 in accordance with one embodiment of the present disclosure. Resonator 200 comprises single-pedestal dielectric resonator 201 located within metallic rectilinear cavity 202. Dielectric resonator 201 comprises cylindrical post 203 topped by cylindrical pedestal 204. Note that, while architecturally, pedestals are placed below their corresponding columns or posts, as used herein, a pedestal refers to a capping structure that may be located at either end of a post. Furthermore, note that "top" and "bottom" are used herein for convenience in reference to particularly illustrated exemplary embodiments and are not limiting in terms of particular orientation with respect to any global coordinate systems. In addition, note that, as used herein, cylinder refers to a solid having congruent, parallel, elliptical bases and a substantially uniform cross-section along its height.

Dielectric resonator 201 may be made of a suitable ceramic material having a dielectric constant greater than but not limited to 10. In one implementation, the ceramic material has a dielectric constant of 43. Resonant cavity 202 may be made of a suitable metal, for example, copper or aluminum. The bottom of post 203 is placed on the thin layer of insulator supports (not shown) which are in contact with the inner surface of the bottom side 206 of cavity 202 and form gap 205 between the distal end of post 203 and the inner surface of bottom side 206 of cavity 202. In one implementation, the thin insulator has a thickness of 200 μm. In alternative embodiments, the insulator supports can be omitted and the bottom of post 203 can be in direct contact with the inner surface of the bottom side 206 of cavity 202. The top of pedestal 204 is separated from the inner surface of the top side 207 of cavity 202 by air gap 208. In one implementation, air gap 208 is 0.2 mm and is maintained by a plurality of 0.2 mm thick insulating pads (not shown) that may be made of a suitable insulating material, such as, for example, polytetrafluoroethylene (PTFE) or an Alumina-based ceramic or thin film material, and located between the top of pedestal 204 and the top side 207 of cavity 202. In one implementation, the inner dimensions of cavity 202 are 20 mm (long)×20 mm (wide)×15 mm (high). Note that the dominant mode of the fundamental resonance of the dielectric-loaded resonator described above is the TM (transversal magnetic) mode.

Figure 2B:
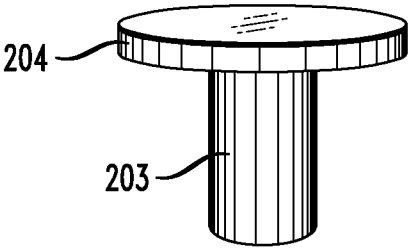
FIG. 2B shows a perspective view of the dielectric resonator of FIG. 2A.

FIG. 2B shows a perspective view of dielectric resonator 201 of FIG. 2A. Post 203 and pedestal 204 are right circular cylinders having a common axis but different diameters. In one implementation, the dimensions of pedestal 204 are a height of 2 mm and radius of 10 mm (consequently, in contact with the side walls of cavity 202) and the dimensions of post 203 are a height of 12.8 mm and radius of 3.65 mm.

Figure 1:
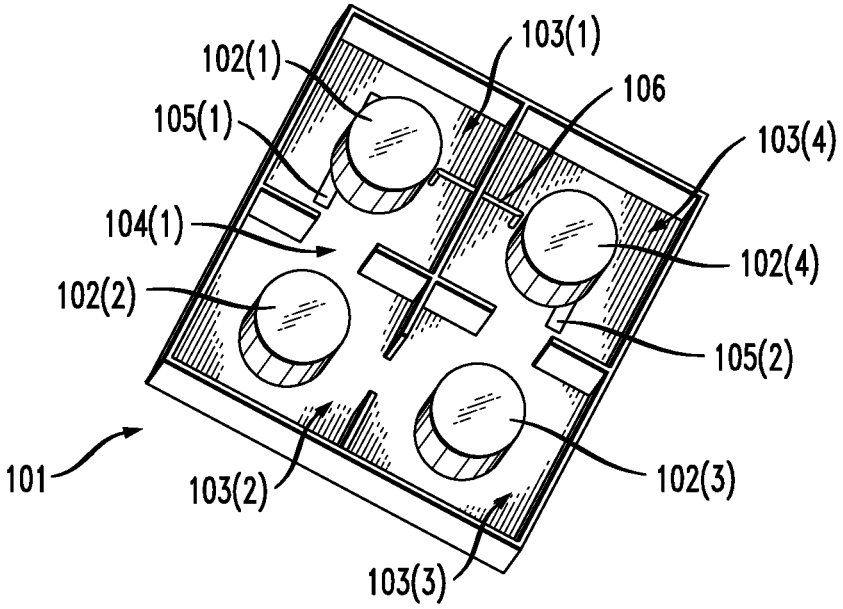
FIG. 1 PRIOR ART
FIG. 1. shows a perspective view of an uncovered conventional resonator filter.
Figure 3A:
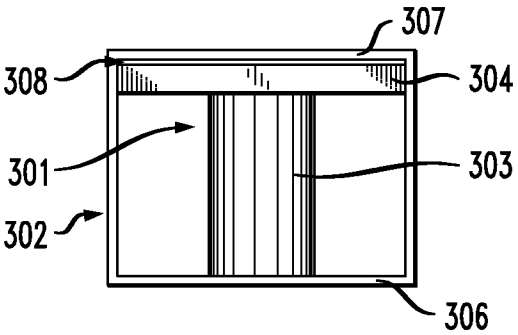
FIG. 3A shows a side cross-section view of a dielectric-loaded cavity resonator in accordance with another embodiment of the present disclosure.

FIG. 3A shows a side cross-section view of dielectric-loaded cavity resonator 300 in accordance with another embodiment of the present disclosure. Resonator 300 comprises single-pedestal dielectric resonator 301 located within metallic rectilinear cavity 302. Dielectric resonator 301 comprises cylindrical post 303 topped by rectangular pedestal 304.

Dielectric resonator 301 may be made of a suitable ceramic material, as described above. Cavity 302 may be substantially similar to cavity 202 of FIG. 2A. The bottom of post 303 is in contact directly with the inner surface of bottom side 306 of cavity 302. In alternative embodiments, the bottom of post 303 may be separated from the inner surface of bottom side 306 by a thin insulator, as described above in reference to post 203 of FIG. 2A. The top of pedestal 304 is separated from the inner surface of the top side 307 of cavity 302 by air gap 308. In one implementation, air gap 308 is 0.2 mm and is maintained by a plurality of 0.2 mm thick insulating pads (not shown) that may be made of PTFE and located between the top of pedestal 304 and the top side 307 of cavity 302.

Figure 3B:
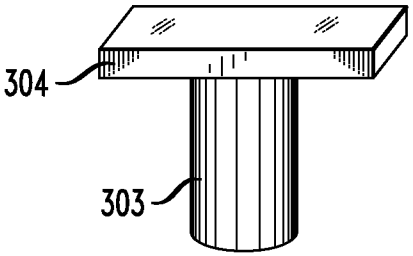
FIG. 3B shows a perspective view of the dielectric resonator of FIG. 3A.

FIG. 3B shows a perspective view of dielectric resonator 301 of FIG. 3A. Post 303 is a right circular cylinder, while pedestal 304 is a square prism, the two having a common central axis but different cross-sections. In one implementation, the dimensions of pedestal 304 are 20 mm (width)×20 mm (length)×2 mm (height) (and, consequently, in contact with the side walls of cavity 302) and the dimensions of post 303 are height of 12.8 mm and radius of 3.64 mm.

Particular novel configurations of pluralities of single-pedestal dielectric-loaded cavity resonators such as resonator 200 of FIG. 2A or resonator 300 of FIG. 3A allows for the creation of filters having capacitive coupling between pairs of dielectric-loaded resonators—and, consequently, transmission zeros in the corresponding frequency-response characteristics—without the use of conductive coupling wires between them. In particular, configuring the plurality of pedestal-based dielectric resonators of the filter so that at least one dielectric resonator is oriented upside-down—in other words, has its pedestal on the bottom of its post—creates capacitive coupling between that dielectric resonator and one or more other dielectric resonators of the plurality that are oriented right-side up. This means that zeros may be added to the frequency-response characteristics of the filter with the flipping of one or more dielectric resonators and without the use of conductive wires between resonant cavities.

Figure 4:
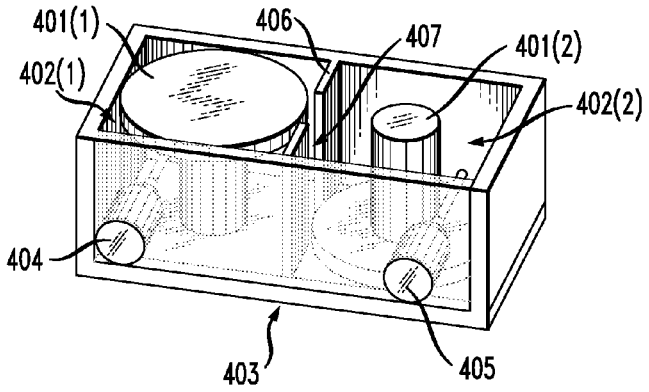
FIG. 4 shows a perspective view of a filter, with its top side removed, in accordance with one embodiment of the present disclosure.

FIG. 4 shows a perspective cross-section view of filter 400, with its top side (not shown) removed, in accordance with one embodiment of the present disclosure. Filter 400 comprises two dielectric resonators 401(1)-401(2) within two corresponding resonant cavities 402(1)-402(2) within housing 403. Dielectric resonator 401(1) is oriented so that its pedestal is on top of its post, while dielectric resonator 401(2) is oriented in the opposite direction so that its pedestal is below its post. The pedestals of dielectric resonators 401(1)-401(2) are separated from the near inner surfaces of the corresponding cavities 402(1)-402(2) by an air gap, as described above. Filter 400 further comprises coaxial source port 404 connected to resonant cavity 402(1) and coaxial load port 405 connected to resonant cavity 402(2). Wall 406 separating resonant cavities 402(1) and 402(2) has an opening 407. Opening 407 inductively couples dielectric resonators 401(1) and 401(2), while the mirrored orientations of dielectric resonators 401(1) and 401(2) capacitively couples them and creates transmission zeros in the filter's frequency response.

Figure 5:
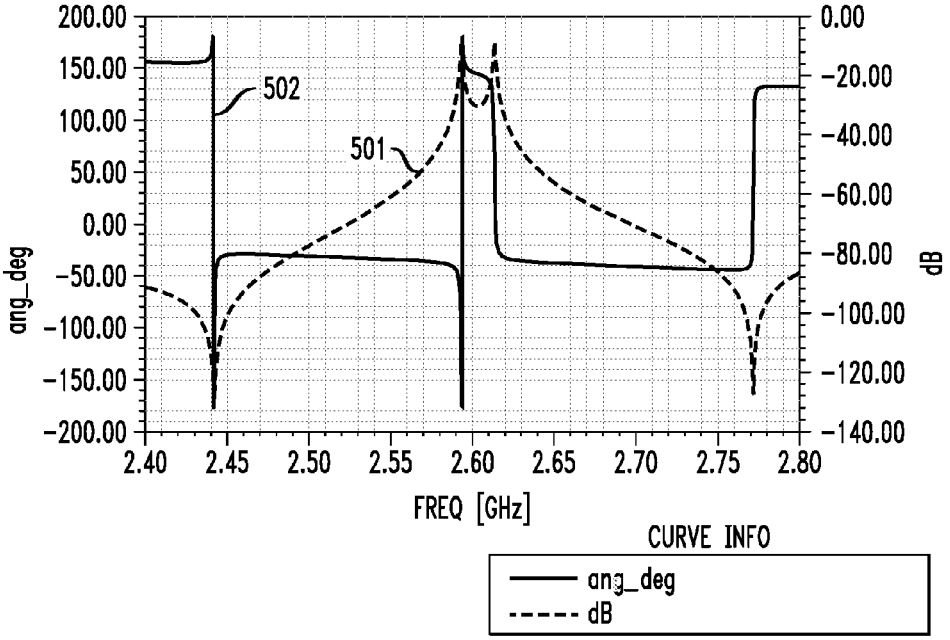
FIG. 5 shows a graph that includes the frequency response and phase shift for the filter of FIG. 4 at a first harmonic mode.

FIG. 5 shows graph 500, which includes the frequency-response curve of the amplitude 501 and the frequency-response curve of the phase 502 for the filter 400 of FIG. 4 at a first harmonic mode, which is the dominant harmonic mode for filter 400, where the dimensions of dielectric resonators 401(1)-401(2) and cavities 402(1)-402(2) are the same as the exemplary dimensions provided above for dielectric resonator 201 and cavity 202 of FIGS. 2A and 2B. Specifically, (i) exemplary curve 501 plots the power loss, in decibels shown on the right vertical axis, from an input signal at source port 404, at the frequencies in GHz shown on the horizontal axis, as measured at load port 405 and (ii) exemplary curve 502 plots the phase shift, in degrees (i.e., ang deg) shown on the left vertical axis, from an input signal at source port 404, at the frequencies shown on the horizontal axis, as measured at load port 405. Note that additional harmonic modes occur at higher frequencies. Frequency-response curve 501 shows the forward-gain coefficient—sometimes referred to as S21—for filter 400 over a range of frequencies. As can be seen, the center frequency for filter 400 is approximately 2.6 GHz, and there are two transmission zeros at approximately 2.44 GHz and 2.77 GHz.

Figure 6A:
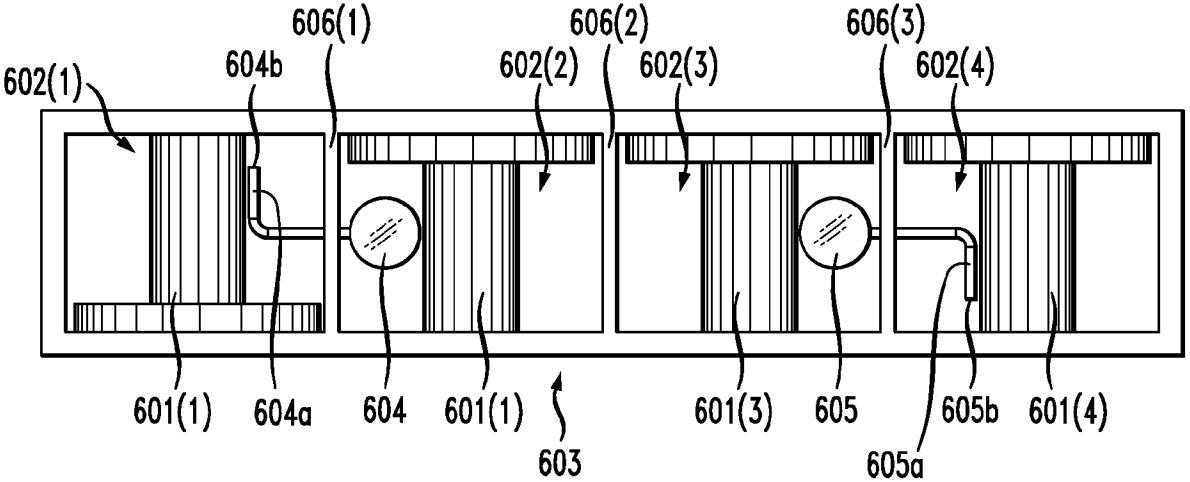
FIG. 6A shows a side cross-section view of an in-line filter, in accordance with one embodiment of the present disclosure.

FIG. 6A shows a side cross-section view of in-line filter 600, in accordance with one embodiment of the present disclosure. Filter 600 comprises four pedestal-based dielectric resonators 601(1), 601(2), 601(3), and 601(4) located within four corresponding metallic resonant cavities 602(1), 602(2), 602(3), and 602(4) within housing 603. The walls 606(1), 606(2), and 606(3) between adjoining resonant cavities 602 have openings (not shown) in them to allow for inductive or capacitive coupling between dielectric resonators. Dielectric resonators 601(2)-601(4) are oriented in a first direction with their respective pedestals on top, while dielectric resonator 601(1) is oriented in a second direction, opposite to the first direction, with its pedestal on the bottom.

The distal ends of the posts of the dielectric resonators are separated by a thin insulator (not shown) from the near walls of the corresponding resonant chambers, and the distal ends of the pedestals of the dielectric resonators are similarly separated by thin insulators (not shown) from the opposing walls, as discussed above. In other words, (i) the bottoms of the posts of dielectric resonators 601(2)-601(4) are separated by thin insulators from the bottom sides of resonant cavities 602(2)-602(4), (ii) the top of the post of dielectric resonator 601(1) is separated by a thin insulator from the top side of resonant cavity 602(1), (iii) the tops of the pedestals of dielectric resonators 601(2)-601(4) are separated by an air gap from the top sides of resonant cavities 602(2)-602(4), and (iv) the bottom of the pedestal of dielectric resonator 601(1) is separated by an air gap from the bottom side of resonant cavity 602(1). This configuration of the flipped pedestal-based dielectric resonators 601(1)-601(4) in filter 600 allows for capacitive coupling between pairs of dielectric resonators 601(1)-601(4) without the use of conductive wires.

Filter 600 further comprises coaxial source port 604—whose center line couples to dielectric resonator 601(1)—and coaxial load port 605—whose center line couples to dielectric resonator 601(4). The center lines of the source and load ports 604 and 605 are bent—or L-shaped—so that their respective terminal lengths 604*a* and 605*a* run parallel to the posts of the corresponding dielectric resonators 601(1)-601(4) and their respective ends 604*b* and 605*b* point away from the corresponding pedestal. This bending of the center lines helps enhance coupling between the center line and the corresponding dielectric resonator. Note that terminal lengths 604*a* and 605*a* come close to, but do not contact, the posts of dielectric resonators 601(1) and 601(4).

Figure 6B:
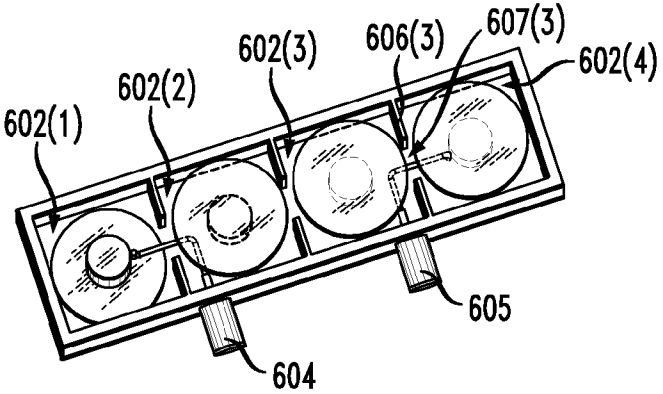
FIG. 6B shows a perspective view of the in-line-configuration filter of FIG. 6A with its top side removed.

FIG. 6B shows a perspective view of in-line-configuration filter 600 of FIG. 6A, with its top side (not shown) removed. The walls separating adjoining resonant cavities 602(1)-602(4) include openings 607(3) such as, for example, opening 607(3) in wall 606(3) between resonant cavities 602(3) and 602(4). Using the same exemplary dimensions for dielectric resonators 601(1)-601(4) and cavities 602(1)-602(4) of FIG. 6A as for resonator 201 and cavity 202 of FIGS. 2A and 2B above would result in frequency-response characteristics for filter 600 that include a center frequency at 2.60 GHz and zeros at approximately 2.49 GHz and 2.70 GHz—which are closer to the center frequency—and indicative of a higher Q factor—than the above-described zeros of the two-resonator filter 400 of FIG. 4 and shown in FIG. 5.

Figure 7:
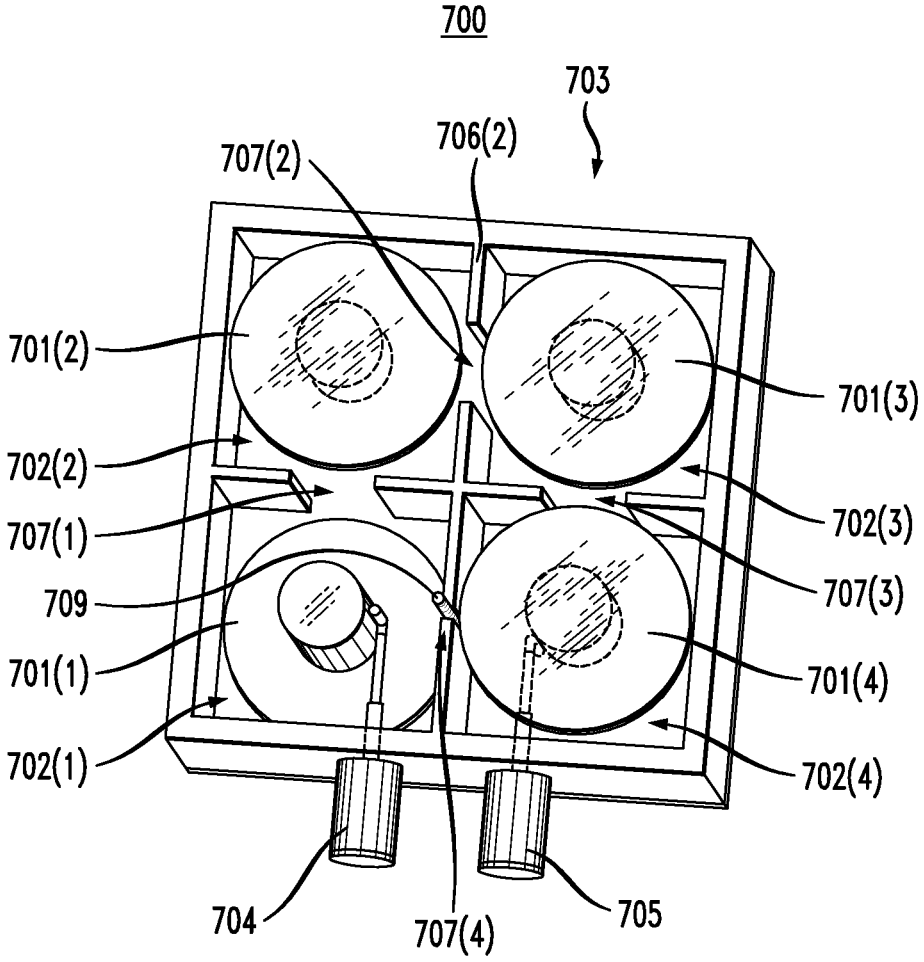
FIG. 7 shows a perspective view of a folded-configuration filter in accordance with another embodiment of the disclosure with its top side removed.

FIG. 7 shows a perspective view of folded-configuration filter 700 in accordance with another embodiment of the disclosure. The top side of filter 700—which forms the top surface of the cavities—is not shown. Filter 700 comprises four dielectric resonators 701(1), 701(2), 701(3), and 701(4) disposed within four corresponding resonant cavities 702(1), 702(2), 702(3), and 702(4) arranged as a 2×2 grid within metallic housing 703. The walls 706(2) separating adjoining resonant cavities 702(1)-702(4) have openings 707(1), 707(2), 707(3), and 707(4) in them—such as, for example, opening 707(2) in wall 706(2) between resonant cavities 702(2) and 702(3). Opening 707(4)—between resonant cavities 702(4) and 702(1)—includes tuning screw 709 whose adjustment varies the size of opening 707(4). The adjusting of tuning screw 709 allows for the adjustment of the location of zeros in the frequency-response characteristics of filter 700.

Similarly to the dielectric resonators 601(1)-601(4) of FIGS. 6A and 6B, dielectric resonators 701(2)-701(4) are oriented in a first direction with their respective pedestals on top, while dielectric resonator 701(1) is oriented in a second direction, opposite to the first direction, with its pedestal on the bottom. In addition, the distal ends of the posts—i.e., the post ends away from the pedestals—of the dielectric resonators 701(1)-701(4) are separated from the near walls of the corresponding resonant chambers 702(1)-702(4) by thin insulators (not shown), while the pedestals of the dielectric resonators 701(1)-701(4) are separated from the opposing walls by an air gap, as described above. This configuration of the pedestal-based dielectric resonators 601(1)-601(4) in filter 600 allows for capacitive coupling between pairs of dielectric resonators 701(1)-701(4) without the use of conductive wires.

Filter 700 further includes coaxial source port 704 and coaxial load port 705. Similarly to the center lines of the ports of filter 600 described above, the center lines of the ports are bent so that their terminal lengths run parallel to the posts of the corresponding dielectric resonators 701(1)-701(4) and their ends point away from the corresponding pedestal. Dielectric resonator 701(1) forms a first set of dielectric resonators oriented in one direction and dielectric resonators 701(2)-701(4) form a second set of dielectric resonators oriented in the opposite direction. As can be seen, in this embodiment, (i) source port 704 couples with a resonator of the first set and (ii) load port 705 couples with a resonator of the second set of the filter 700. In alternative embodiments, both source and load ports might couple to two dielectric resonators of the same set—in other words, to two dielectric resonators oriented in the same direction.

Using the same exemplary dimensions for dielectric resonators 701(1)-701(4) and cavities 702(1)-702(4) as for resonators 601(1)-601(4) and cavities 602(1)-602(4) of FIGS. 6A and 6B above would result in frequency-response characteristics including a center frequency at 2.60 GHz and zeros at approximately 2.51 GHz and 2.70 GHz, which are closer to the center frequency—and indicative of a higher Q factor—than the above-described zeros of the in-line-configuration filter 600.

Embodiments of the disclosure have been described where the pedestal is separated from the top side or bottom side of the corresponding resonant cavity by an air gap. However, the invention is not so limited. In some alternative embodiments, the distal end of the pedestal—i.e., the pedestal end away from the post—is in contact with the top side or bottom side of the corresponding resonant cavity. In some alternative embodiments, the distal ends of both the pedestal and the post are separated from the nearby sides of the corresponding resonant cavity by respective air gaps.

Embodiments of the disclosure have been described where the post and the corresponding pedestal of a dielectric resonator are solid. However, the invention is not so limited. In some alternative embodiments, the post and/or pedestal have hollowed-out centers. The hollows may be cylindrical or of other shapes.

Embodiments of the disclosure have been described where the pedestals of the dielectric resonators are either circular or square and extend to the side walls of the corresponding cavity. However, the invention is not so limited. In some alternative embodiments, the pedestals have other shapes and/or are of a shape and/or size that does not contact the side walls of the corresponding cavity. In some embodiments, the area of the cross-section of the pedestal is greater than the area of the cross-section of the post so that the pedestal extends beyond the post. In some embodiments, the area of the cross-section of the pedestal that extends beyond the post is at least as great as the area of the cross-section of the post. In other words, in these embodiments, if the cross-sectional area of the post is x, then the cross-sectional area of the pedestal is at least 2x and the area of the pedestal overhang is at least x.

Embodiments of the disclosure have been described where the plurality of dielectric resonators and corresponding resonator cavities are arranged either in-line or in a rectangular grid. However, the invention is not so limited. In alternative embodiments, the dielectric resonators are arranged in non-rectangular-grid patterns.

Embodiments of the disclosure have been described where the filter comprises two or four dielectric resonators and corresponding resonant cavities. However, the invention is not so limited. In alternative embodiments, filters have different numbers of dielectric resonators and corresponding resonant cavities.

Embodiments of the disclosure have been described where only one dielectric resonator has an orientation opposite to the orientation of the other dielectric resonators. However, the invention is not so limited. In alternative embodiments, a first plurality of dielectric resonators is oriented in a first direction and a second plurality of dielectric resonators is oriented in a second direction that is the reverse of the first direction.

Embodiments of the disclosure have been described where coaxial ports are used to feed the dielectric and cavity resonators. However, the invention is not so limited. In some alternative embodiments, other feed means—such as, for example, micro-strip lines—are used to feed the resonators.

Embodiments of the disclosure have been described where all of the pedestal-based dielectric resonators of a filter are substantially identical. However, the invention is not so limited. In some alternative embodiments, one or more of the dielectric resonators of a filter are different from other dielectric resonators of the filter. For example, in some embodiments, a filter comprises some resonators with a cylindrical pedestal and some resonators with a rectangular-prism pedestal.

Embodiments of the disclosure have been described where the separation—via air gap or thin insulator—between parts of a dielectric resonator and a near wall is 0.2 mm (or 200 m). In some alternative embodiments, the separation may as narrow as 50 μm or as wide as 300 μm.

In some embodiments of the disclosure, the Q factor associated with the ceramic material of the dielectric resonator is greater than 1000.

Signals and corresponding nodes or ports may be referred to by the same name and are interchangeable for purposes here.

It will be further understood that various changes in the details, materials, and arrangements of the parts which have been described and illustrated in order to explain the nature of this invention may be made by those skilled in the art without departing from the scope of the invention as expressed in the following claims.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

Unless explicitly stated otherwise, each numerical value and range should be interpreted as being approximate as if the word "about" or "approximately" preceded the value of the value or range. As used in this application, unless otherwise explicitly indicated, the term "connected" is intended to cover both direct and indirect connections between elements.

For purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. The terms "directly coupled," "directly connected," etc., imply that the connected elements are either contiguous or connected via a conductor for the transferred energy.

The use of figure numbers and/or figure reference labels in the claims is intended to identify one or more possible embodiments of the claimed subject matter in order to facilitate the interpretation of the claims. Such use is not to be construed as limiting the scope of those claims to the embodiments shown in the corresponding figures.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

Although the steps in the following method claims are recited in a particular sequence with corresponding labeling, unless the claim recitations otherwise imply a particular sequence for implementing some or all of those steps, those steps are not necessarily intended to be limited to being implemented in that particular sequence.

We claim:

1. A cavity-resonator filter comprising:

a first pedestal-based dielectric resonator mounted in a first resonant cavity and oriented in a first direction;

a second adjacent pedestal-based dielectric resonator mounted in a second different resonant cavity and oriented in a second direction opposite the first direction; and a wall located between said first and second dielectric resonators.

2. The filter of claim 1, wherein:

the first pedestal-based dielectric resonator comprises a right cylindrical post connected to a pedestal.

3. The filter of claim 2, wherein the right cylindrical post includes a hollowed-out section.

4. The filter of claim 2, wherein the pedestal comprises a circular cylinder having a radius larger than a radius of the right cylindrical post.

5. The filter of claim 2, wherein the right cylindrical post has a circular cross section.

6. The filter of claim 2, wherein:

the distal end of the post is in contact with a first side of the first resonant cavity; and the distal end of the pedestal is separated from a second opposite side of the resonant cavity by an air gap.

7. The filter of claim 1, wherein the wall comprises an opening between the first and second resonant cavities.

8. The filter of claim 7, further comprising a tuning screw configured to adjust a size of said opening.

9. The filter of claim 1, wherein the first dielectric resonator of comprises a ceramic material having a dielectric constant greater than 10.

10. The filter of claim 1, wherein each of the first and second resonant cavities is metallic and rectilinear.

11. The filter of claim 1, wherein said first and second dielectric resonators are not conductively coupled.

12. The filter of claim 1, further comprising:

a source port coupled to the first dielectric resonator; and a load port coupled to the second dielectric resonator.

13. The filter of claim 12, wherein:

the first and second pedestal-based dielectric resonators each comprise a post connected to a corresponding pedestal;

the source port and the load port each comprise a respective coaxial port, each port having a corresponding first and second center line;

the first center line is bent such that the first center line includes a terminal length that runs parallel to a corresponding post of the first dielectric resonator and has a respective end that points away from a corresponding pedestal of the first dielectric resonator; and the second center line is bent such that the second center line includes a terminal length that runs parallel to a corresponding post of the second dielectric resonator and has a respective end that points away from a corresponding pedestal of the second dielectric resonator.

14. The filter of claim 1, further comprising a third pedestal-based dielectric resonator oriented in said first direction.

15. The filter of claim 14, wherein the first, second and third dielectric resonators are arranged in a linear array.

16. The filter of claim 14, wherein the first, second and third dielectric resonators are arranged in a two-dimensional array.

17. A cavity-resonator filter comprising:

a first set of one or more pedestal-based dielectric resonators, each pedestal-based dielectric resonator of the first set being mounted in a corresponding resonant cavity and oriented in a first direction; and a second set of one or more pedestal-based dielectric resonators, each pedestal-based dielectric resonator of the second set being mounted in a corresponding resonant cavity and oriented in a second direction opposite to the first direction, wherein each pedestal-based dielectric resonator of the first and second sets comprises a respective post connected to a corresponding pedestal and a first pedestal-based dielectric resonator of the first set is adjacent to a first pedestal-based dielectric resonator of the second set.

18. The filter of claim 17, wherein a distal end of a respective pedestal of at least one pedestal-based dielectric resonator of the first and second sets is in contact with a first side of a corresponding resonant cavity.

19. The filter of claim 17, wherein:

a distal end of each pedestal is supported by a corresponding first insulator in contact with a first side of the corresponding resonant cavity; and a distal end of each corresponding post is supported by a second thin insulator in contact with a second side of the corresponding resonant cavity, opposite from the first side.

20. A method of manufacturing, comprising:

mounting in a first resonant cavity a first pedestal-based dielectric resonator oriented in a first direction; and mounting in a second resonant cavity a second pedestal-based dielectric resonator adjacent to said first pedestal-based dielectric resonator and oriented in a second direction opposite to the first direction, wherein a wall is located between said first and second resonant cavities.

* * * * *